US012570426B2

(12) United States Patent
Huang

(10) Patent No.: US 12,570,426 B2
(45) Date of Patent: Mar. 10, 2026

(54) TAPE CUTTING DEVICE IN CARTON SEALER

(71) Applicant: FUJIAN JIALONG ADHESIVE TAPE CO., LTD., Zhangzhou (CN)

(72) Inventor: Benyu Huang, Ningde (CN)

(73) Assignee: FUJIAN JIALONG ADHESIVE TAPE CO., LTD., Zhangzhou (CN)

( * ) Notice: Subject to any disclaimer, the term of this patent is extended or adjusted under 35 U.S.C. 154(b) by 109 days.

(21) Appl. No.: 18/410,969

(22) Filed: Jan. 11, 2024

(65) Prior Publication Data

US 2025/0229932 A1 Jul. 17, 2025

(51) Int. Cl.

| | |
|---|---|
| ***B65B 61/06*** | (2006.01) |
| ***B65B 51/06*** | (2006.01) |
| ***B65H 35/00*** | (2006.01) |

(52) U.S. Cl.

CPC ..... *B65B 61/06* (2013.01); *B65B 51/067* (2013.01); *B65H 35/0013* (2013.01); *B65H 35/0073* (2013.01); *B65H 2701/377* (2013.01)

(58) Field of Classification Search

CPC ... B65B 61/06; B65B 51/067; B65H 35/0073; B65H 35/0013

See application file for complete search history.

(56) References Cited

U.S. PATENT DOCUMENTS 53,416 A * 3/1866 Cole ..... B02C 1/14 83/636
606,261 A * 6/1898 Yates ..... B27B 27/02 83/912
3,046,825 A * 7/1962 Thompson ..... B23D 35/002 100/98 R
3,352,266 A * 11/1967 Micale ..... D05B 37/066 83/918
3,467,514 A * 9/1969 Mcnamara ..... C03B 7/10 65/133
3,956,952 A * 5/1976 Goettel ..... B26F 1/12 83/636
4,455,904 A * 6/1984 Havner ..... F16P 3/04 83/466
4,831,910 A * 5/1989 Poulsen ..... B27G 5/04 83/636
5,231,908 A * 8/1993 Skvarce ..... B23D 21/00 403/348

(Continued)

FOREIGN PATENT DOCUMENTS

| | | |
|---|---|---|
| CN | 207725769 U | 8/2018 |
| CN | 211467903 U | 9/2020 |
| CN | 216686840 U | 6/2022 |

*Primary Examiner* — Sean M Michalski
(74) *Attorney, Agent, or Firm* — Nitin Kaushik

(57) ABSTRACT

The present disclosure provides a tape cutting device in a carton sealer. The device includes a cutter holder, a fixed blade and a movable blade. The movable blade slides to the fixed blade to cut off a tape, and a cutting edge of the movable blade is designed to be of an isosceles triangle structure. This way can reduce a resistance caused by cutting the tape by using the movable blade, and is also beneficial to the conservation of electric energy required by a cutting motor. In addition, by sensing a position of an eccentric pin through a distance sensor in a process that the tape is cut off, the movable blade can automatically reset to be away from the fixed blade, which is convenient for re-packaging and cutoff.

5 Claims, 10 Drawing Sheets

(56) References Cited

U.S. PATENT DOCUMENTS

| | | | | | |
|---|---|---|---|---|---|
| 5,463,920 | A * | 11/1995 | Korb | B26D 3/14 | 83/636 |
| 5,943,930 | A * | 8/1999 | Fasske | B23D 23/02 | 83/456 |
| 6,418,826 | B1 * | 7/2002 | Suzuki | B26D 1/06 | 83/636 |
| 6,439,089 | B1 * | 8/2002 | Fasske | B23D 23/00 | 83/13 |
| 7,107,889 | B2 * | 9/2006 | Marocco | E06B 9/266 | 83/563 |
| 11,660,771 | B2 * | 5/2023 | Oudsen | B26D 1/08 | 83/613 |
| 2009/0165626 | A1 * | 7/2009 | Sundquist | B23D 35/005 | 83/699.41 |
| 2015/0000489 | A1 * | 1/2015 | Koike | B65H 20/02 | 83/73 |
| 2021/0213644 | A1 * | 7/2021 | Trudeau | B26D 1/08 | |

* cited by examiner

TAPE CUTTING DEVICE IN CARTON SEALER

TECHNICAL FIELD

The present disclosure relates to the field of tape cutting devices, in particular to a tape cutting device in a carton sealer.

BACKGROUND

A tape consists of two parts including a substrate and a binder and connects two or more disconnected objects together by binding, and the surface thereof is coated with a layer of adhesive. At present, in a carton sealer adopting a tape without glass fiber ribs, such as a transparent tape, the tape is cut off in a way that the tape is scraped and cut by a jagged cutter by means of a force acting on the cutter due to tape stretching, and thus, the tape is cut off.

However, due to the higher toughness of a tape with glass fiber ribs, it is difficult to cut off such a tape in a traditional cutoff way of the cutter.

SUMMARY

For overcoming defects proposed in the above-mentioned background art, the present disclosure provides a tape cutting device in a carton sealer.

The present disclosure adopts the following technical solution:

provided is a tape cutting device in a carton sealer, wherein the device includes:

a cutter holder, the cutter holder being provided with a penetrative tape through hole, and a tape to be cut off passing through the tape through hole;

a fixed blade, the fixed blade being fixed in the cutter holder and being located on one side of the tape through hole; and a movable blade, the movable blade being located on the other side of the tape through hole and sliding relative to the fixed blade;

wherein a side, corresponding to the fixed blade, of the movable blade is sunken to form a cutting edge, the cutting edge forms an isosceles triangle structure, each of two equal sides in the isosceles triangle structure forms a second edge part, and the two second edge parts are used for cutting off the tape.

In a possible implementation, two sides of the movable blade both extend to the fixed blade to form extension parts, and the two extension parts are both attached to a surface of the fixed blade; and elastic sheets are fixed on two sides of the cutter holder, the elastic sheets are bent to the fixed blade to form elastic parts, and the two extension parts are respectively pressed to the fixed blade by the two elastic parts.

In a possible implementation, the movable blade is fixed on a sliding seat, limiting columns are fixed on two sides of the sliding seat, penetrative limiting holes are formed in two sides of the cutter holder, and the two limiting columns adaptively penetrate into the two limiting holes, respectively.

In a possible implementation, the device further includes a cutting motor, an eccentric wheel and a swing rod, the cutting motor is fixed on a mounting frame of the carton sealer, the eccentric wheel is fixed on an output shaft of the cutting motor, and an eccentric pin is fixed on a position, deviated from the center of a circle, on the surface of the eccentric wheel; and a position close to the middle of the swing rod is limited to rotate relative to the cutter holder, one end of the swing rod is limited to rotate relative to the movable blade, the other end of the swing rod is provided with a waist-shaped hole, and the waist-shaped hole sleeves the outside of the eccentric wheel, so that the eccentric pin pushes the waist-shaped hole of the swing rod to swing.

In a possible implementation, the device further includes a distance sensor and a control module, the distance sensor is fixed outside a side of the eccentric wheel and is triggered after sensing that the eccentric pin gets close, and the control module receives a signal for triggering the distance sensor and controls the cutting motor to pause; and when rotating to be close to the distance sensor, the eccentric pin pushes the swing rod so as to drive the movable blade to be away from the fixed blade.

In a possible implementation, pressing plates are fixed on two sides of the tape through hole in the cutter holder, avoidance gaps are formed in surfaces, facing an inner surface of the cutter holder, of the pressing plates, and two sides of the fixed blade are respectively nested in the two avoidance gaps, so that the fixed blade is pressed to the cutter holder by the pressing plates so as to be fixed.

It can be known from the description for the structure of the present disclosure, compared with the prior art, the present disclosure has the following advantages: in the present disclosure, the cutting edge of the movable blade is designed to be of the isosceles triangle structure. When the movable blade slides to the fixed blade to cut off the tape, a process that the two second edge parts in the isosceles triangle structure perform cutoff from two sides to the middle of the tape can be formed. In this way, a resistance caused when the tape is cut by using the movable blade can be reduced, it is convenient to cut off the tape with higher toughness, and a torque required to drive the movable blade to slide can be reduced, so that the way is also beneficial to energy conservation.

DETAILED DESCRIPTION OF THE EMBODIMENTS

In order to make objectives, technical solutions and advantages of the present application clearer, the present application will be further described in detail below in conjunction with the accompanying drawings.

Below, terms such as "first" and "second" are for descriptive purposes only, and cannot be understood as indicating or implying the relative importance or implicitly indicating the number of indicated technical features. Therefore, the features defined as "first" and "second" may explicitly or implicitly include at least one of the features.

Below, terms such as "first" and "second" are for descriptive purposes only, and cannot be understood as indicating or implying the relative importance or implicitly indicating the number of indicated technical features. Therefore, the features defined as "first" and "second" may explicitly or implicitly include at least one of the features.

Figure 1:
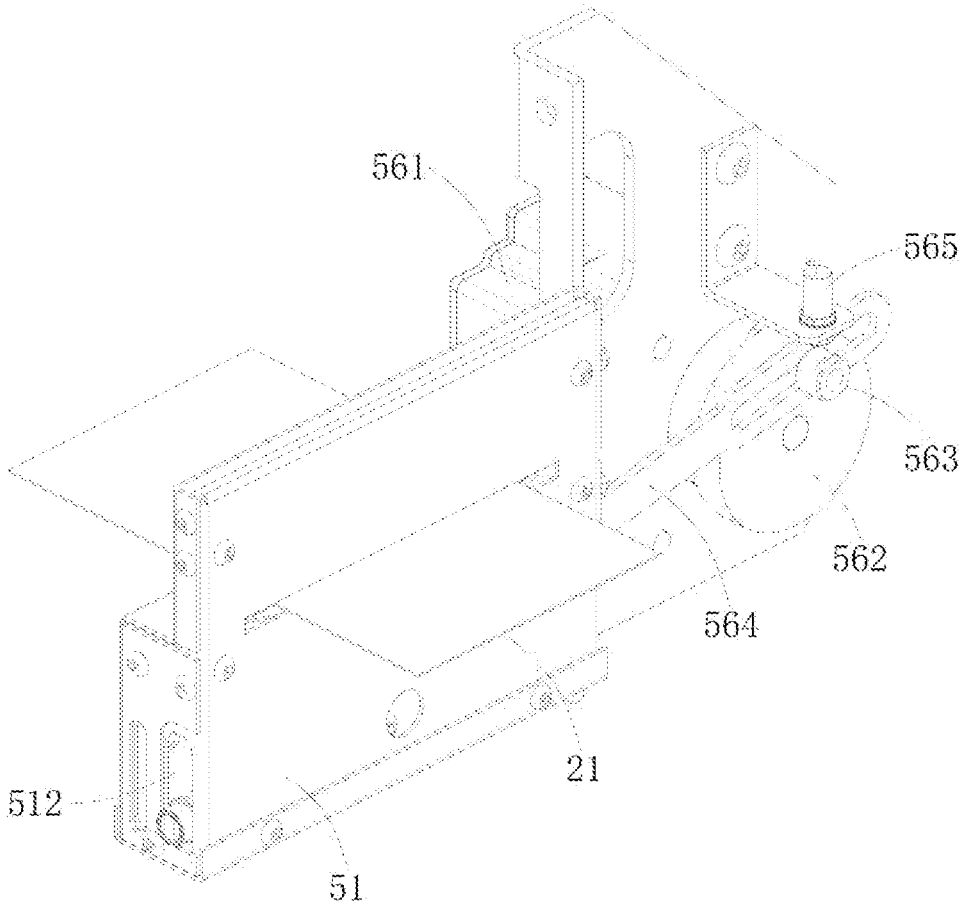
FIG. 1 is a schematic view of a three-dimensional structure of the present disclosure.
Figure 2:
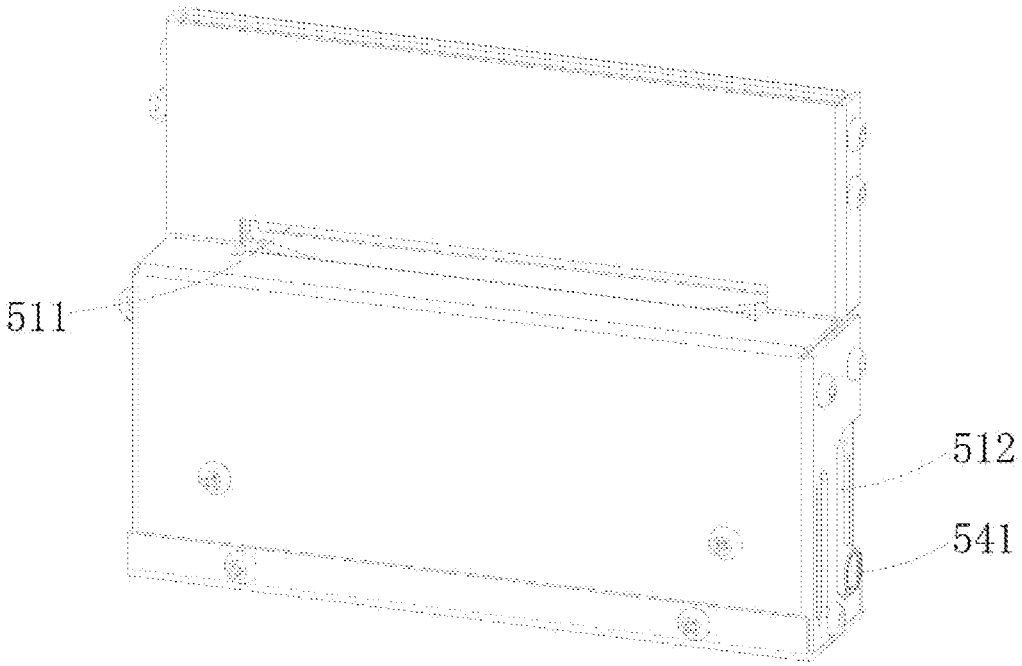
FIG. 2 is a schematic view of a three-dimensional structure of a cutter holder.
Figure 3:
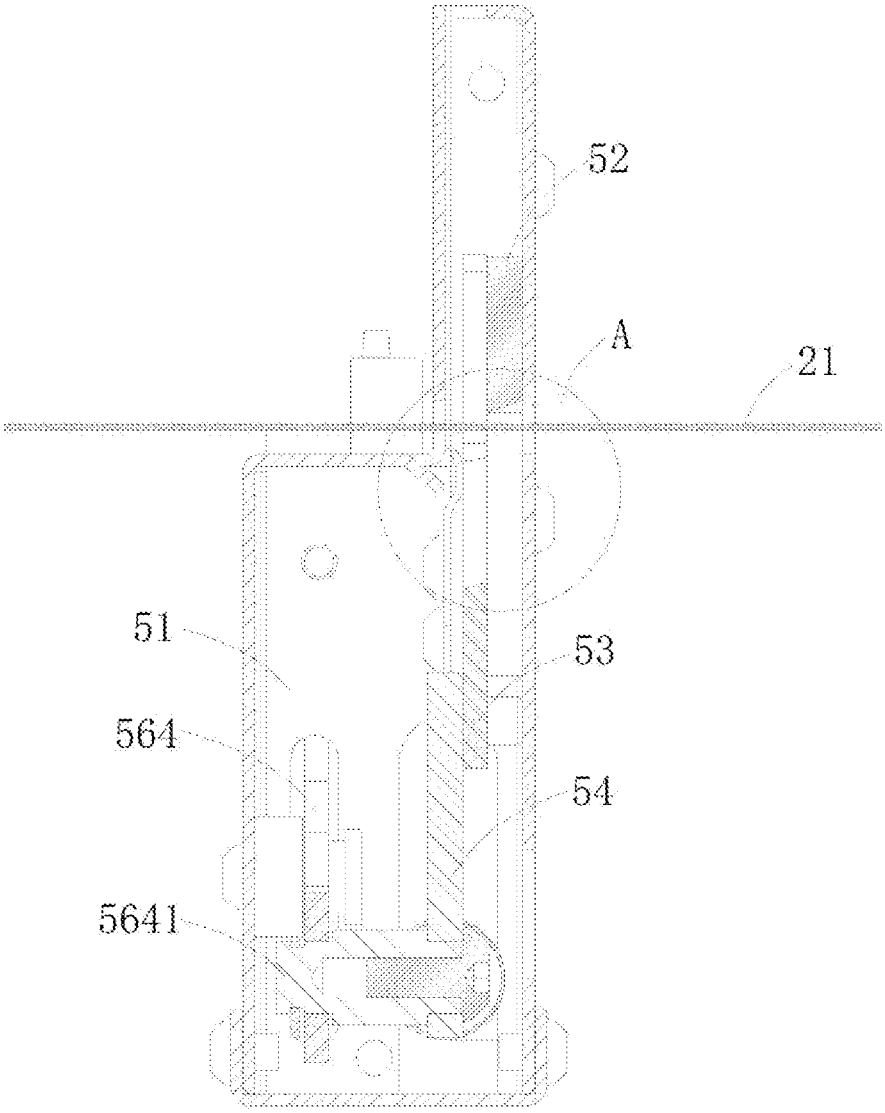
FIG. 3 is a schematic sectional view obtained after a tape passing through a tape through hole of the cutter holder.
Figure 4:
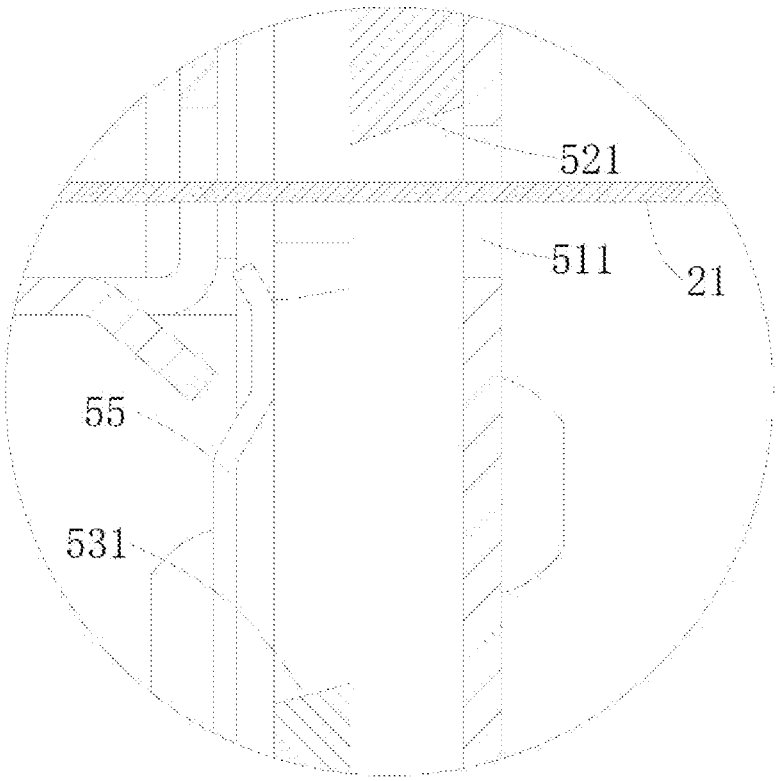
FIG. 4 is a schematic enlarged view of part A in FIG. 3.

The present disclosure discloses a tape cutting device in a carton sealer, as shown in FIG. 1 and FIG. 2, the device includes a cutter holder 51, a fixed blade 52 and a movable blade 53. The cutter holder 51 is fixed on a mounting frame of the carton sealer and is provided with a penetrative tape through hole 511, and a tape 21 to be cut off passes through the tape through hole 511. The fixed blade 52 is fixed in the cutter holder SI and is located on one side of the tape through hole 511, and the movable blade 53 is located on the other side of the tape through hole 511 and slides relative to the fixed blade 52. Further refer to FIG. 3 and FIG. 4, a side, corresponding to the fixed blade 52, of the movable blade 53 is provided with a first edge part 521, a side, corresponding to the movable blade 53, of the fixed blade 52 is provided with a second edge part 531, and by sliding the movable blade 53 to the position of the fixed blade 52, the first edge part 521 is connected with the second edge part 531. In this way, the tape 21 passing through the tape through bole 511 is cut off.

Figure 5:
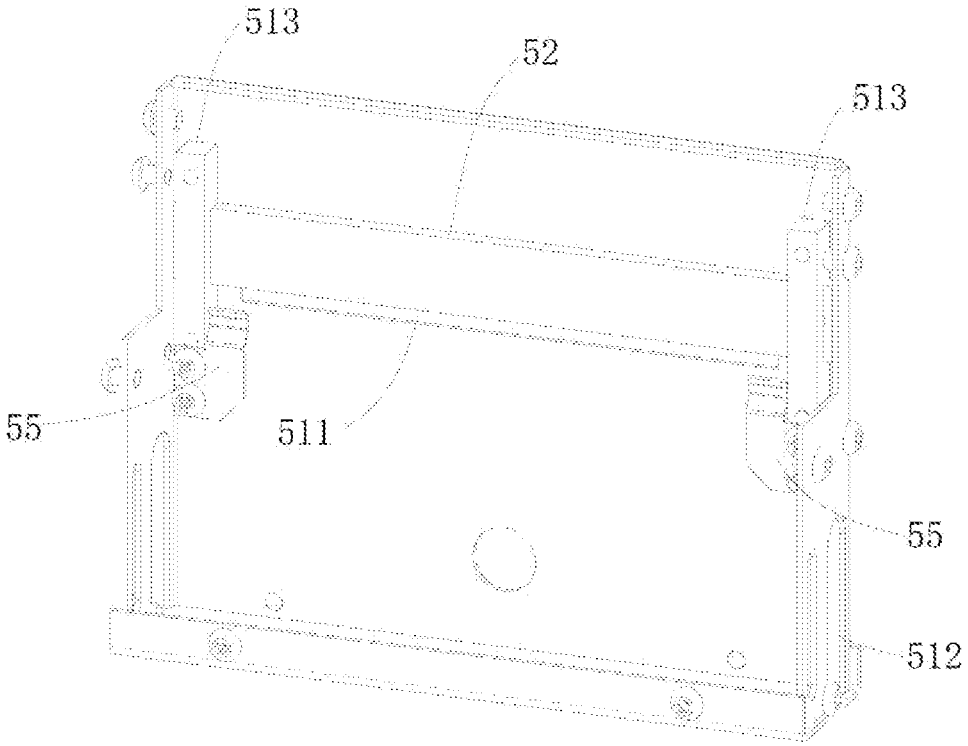
FIG. 5 is a schematic view showing that a fixed blade is fixed inside the cutter holder.

As shown in FIG. 5, pressing plates 513 are fixed on two sides of the tape through hole 511 in the cutter holder 51, and avoidance gaps (unshown in the figure) are formed in surfaces, facing an inner surface of the cutter holder 51, of the pressing plates 513. When the fixed blade 52 is mounted, two sides of the fixed blade 52 are respectively nested in the two avoidance gaps, and then, the two pressing plates 513 are fixed together with the cutter holder 51 in a way of mounting screws, so that the fixed blade 52 is kept to be pressed to the cutter holder 51 by the pressing plates 513 so as to be fixed.

Figure 6:
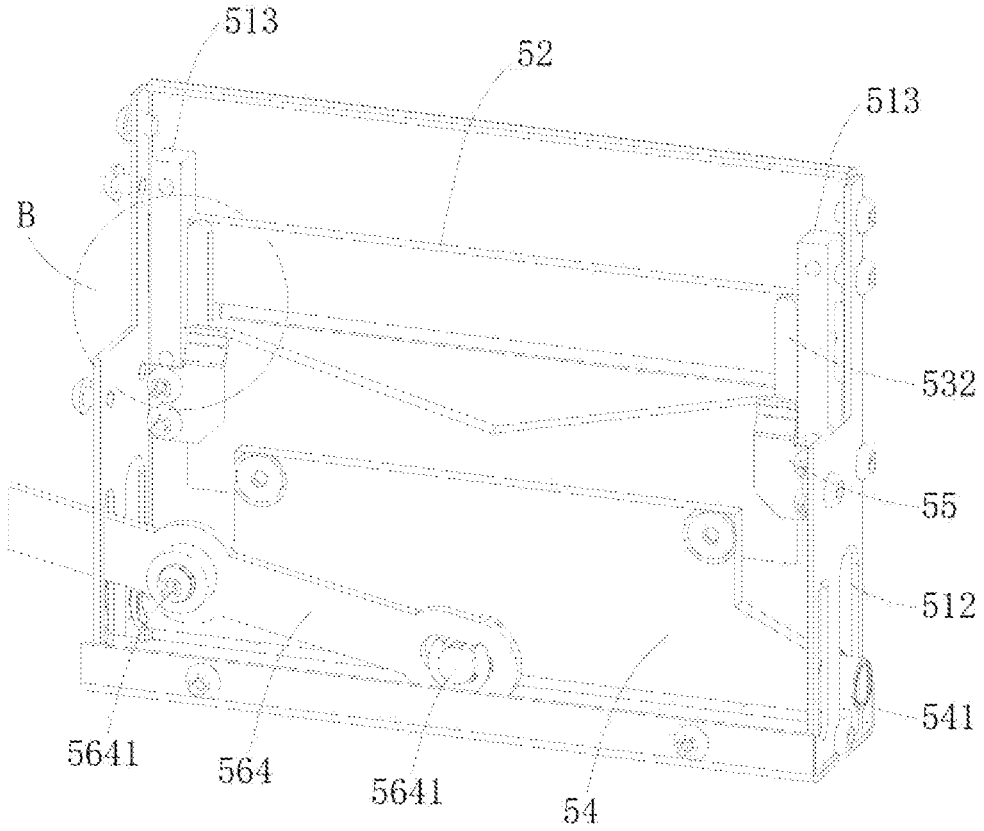
FIG. 6 is a schematic view showing that a movable blade is fixed inside the cutter holder.
Figure 7:
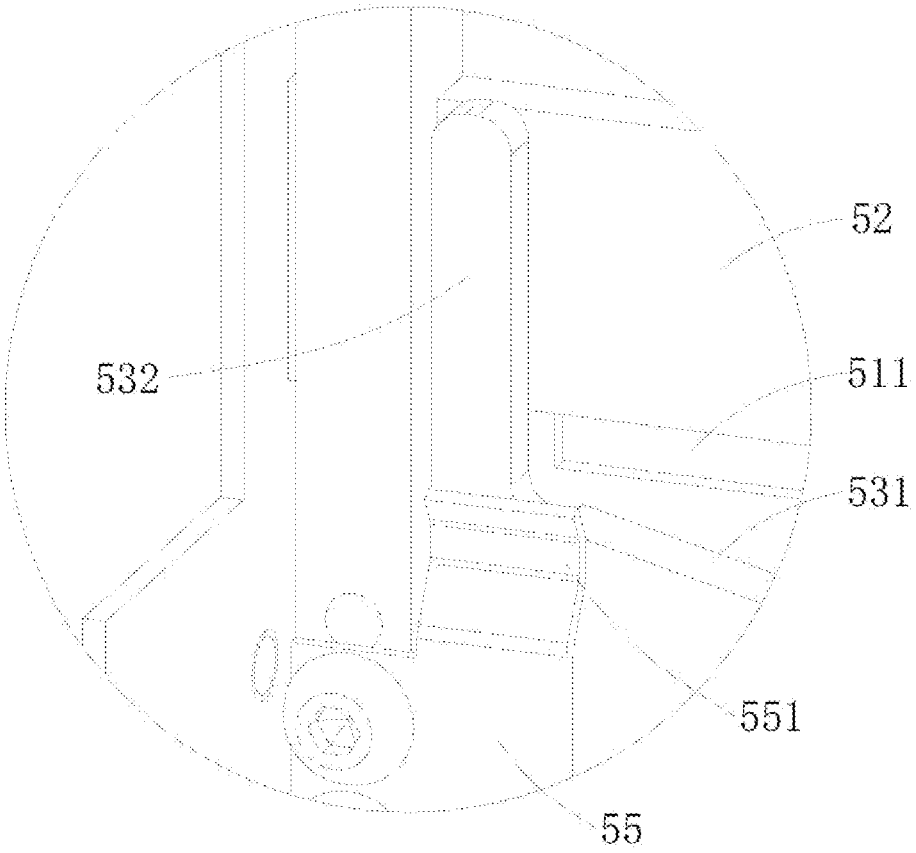
FIG. 7 is a schematic enlarged view of part B in FIG. 6.

The movable blade 53 is located on the other side of the tape through hole 511 and is limited to slide relative to the fixed blade 52 between the two pressing plates 513. A specific structure for limiting the movable blade 53 to slide may be shown as FIG. 6 and FIG. 7, two sides of the movable blade 53 both extend to the fixed blade 52 to form extension parts 532, and the two extension parts 532 are both attached to a surface of the fixed blade 52. Elastic sheets 55 are fixed on two sides of the cutter holder 51, and specifically, one end of each of the elastic sheets 55 may be fixed on each of the pressing plates 513 in a way of mounting screws. In addition, the other ends of the elastic sheets 55 are bent to the fixed blade 52 to form elastic parts 551, and the two extension parts 532 are respectively pressed to the fixed blade 52 by the two elastic parts 551. By means of the structures of the elastic sheets 55, the movable blade 53 may be limited to be always attached to the surface of the fixed blade 52 in a process of sliding relative to the fixed blade 52, so that the second edge part 531 of the movable blade 53 can be tightly connected with the first edge part 521 of the fixed blade 52, and then, the tape 21 can be smoothly cut off. Further refer to FIG. 8, the movable blade 53 is fixed on a sliding seat 54, limiting columns 541 are fixed on two sides of the sliding seat 54, penetrative limiting boles 512 are formed in two sides of the cutter holder 51, and the two limiting columns 541 adaptively penetrate into the two limiting holes 512, respectively. By means of such a structure, the movable blade 53 is limited to be away from one end of each of the extension parts 532, so that the movable blade 53 can only slide straightly relative to the fixed blade 52. Further, the movable blade 53 is fixed together with the sliding seat 54 in a way of mounting screws, so that it is convenient to mount or replace the movable blade 53.

Figure 8:
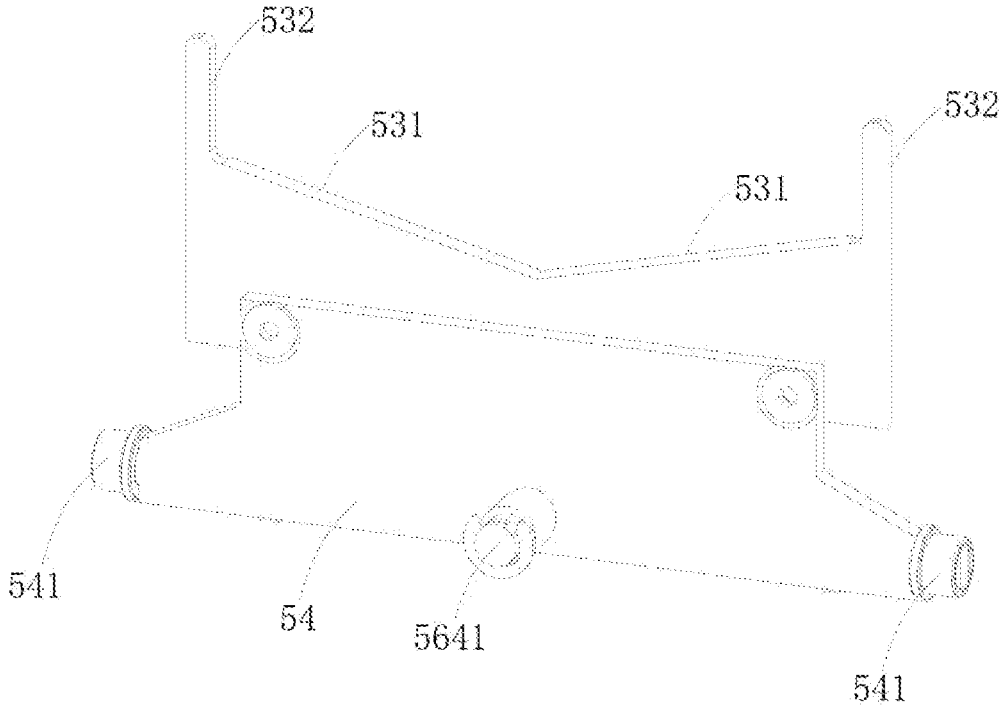
FIG. 8 is a schematic view of a three-dimensional structure that the movable blade is fixed on a sliding seat.

As shown in FIG. 8, a side, corresponding to the fixed blade 52, of the movable blade 53 is sunken to form a cutting edge, the cutting edge forms an isosceles triangle structure, each of two equal sides in the isosceles triangle structure forms the second edge part 531, and the two second edge parts 531 are used for cutting off the tape. When the movable blade 53 slides to the fixed blade 52 to cut off the tape 21, a process that the two second edge parts 531 on the two sides of the movable blade 53 perform cutoff to the middle can be formed. In this way, a resistance caused when the tape 21 is cut by using the movable blade 53 can be reduced, and at the same time, a torque required to drive the movable blade 53 to slide can be reduced, so that the way is beneficial to energy conservation.

Further refer to FIG. 1, the tape cutting device further includes a cutting motor 561 driving the movable blade 53 to slide, an eccentric wheel 562 and a swing rod 564. The cutting motor 561 is fixed on a mounting frame of the carton sealer, the eccentric wheel 562 is fixed on an output shaft of the cutting motor 561, and an eccentric pin 563 is fixed on a position, deviated from the center of a circle, on the surface of the eccentric wheel 562. A position close to the middle of the swing rod 564 is limited to rotate relative to the cutter holder 51, which may be specifically that a pin shaft 5641 is fixed on the cutter holder 51 after passing through the swing rod 564, so that the swing rod 564 rotates relative to the cutter holder 51 with the pin shaft 5641 as an axis. One end of the swing rod 564 is limited to rotate relative to the movable blade 53, and a connection way thereof may be that two ends of the swing rod 564 are both provided with waist-shaped holes 5642, and the waist-shaped hole 5642 in one end thereof sleeves the outside of the pin shaft 5641 fixed on the movable blade 53, so that one end of the swing rod 564 rotates relative to the movable blade 53. The waist-shaped hole 5642 in the other end of the swing rod 564 sleeves the outside of the eccentric pin 563, so that the other end of the swing rod 564 is limited to move relative to the eccentric pin 563. During work, the cutting motor 561 drives the eccentric wheel 562 to rotate so as to drive the eccentric pin 563 to rotate, and the eccentric pin 563 rotates to push parts of the waist-shaped holes 5642 in the swing rod 564 to swing up and down, so that the swing rod 564 swings to drive the movable blade 53 to slide to the fixed blade 52 or a direction away from the fixed blade 52.

Figure 9:
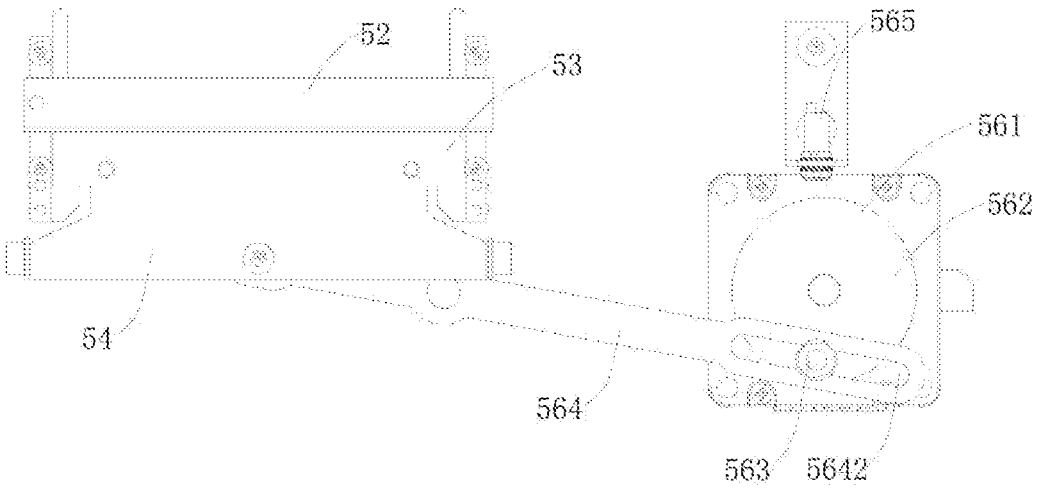
FIG. 9 is a schematic view showing that a swing rod swings to drive the movable blade to slide to the fixed blade.

As shown in FIG. 9, when the cutting motor 561 drives the eccentric wheel 562 to rotate until the eccentric pin 563 is located below, an end of the swing rod 564 is pushed to be downward by the eccentric pin 563, and the end, connected with the movable blade 53, of the swing rod 564 swings to be upward, so that the movable blade 53 slides to the fixed blade 52 to cut off the tape 21. Further refer to FIG. 10, when the cutting motor 561 drives the eccentric wheel 562 to rotate until the eccentric pin 563 is located above, an end of the swing rod 564 is pushed to be upward by the eccentric pin 563, and the end, connected with the movable blade 53, of the swing rod 564 swings to be downward, so that the movable blade 53 is downward, that is, it leaves from the fixed blade 52 to ensure that a gap between the fixed blade 52 and the movable blade 53 is maximum when the movable blade 53 stops moving to allow the tape 21 to smoothly pass through.

Figure 10:
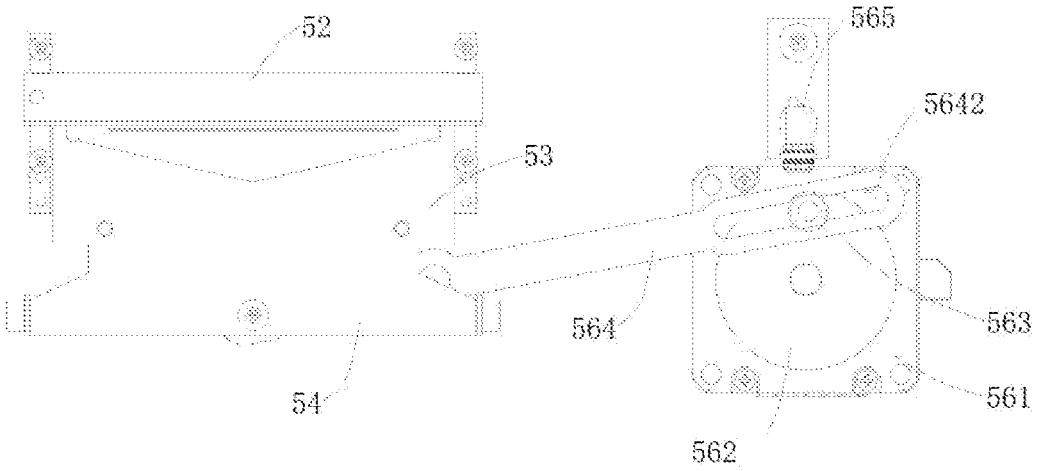
FIG. 10 is a schematic view showing that a swing rod swings to drive the movable blade to slide to a direction away from the fixed blade.

In addition, the tape cutting device further includes a distance sensor 565 and a control module (unshown in the figure), the distance sensor 565 is fixed outside a side of the eccentric wheel 562, such as a position above the eccentric wheel 562 shown in FIG. 9 and FIG. 10, specifically, a connecting rod can be fixed on the mounting frame of the carton sealer to fix the distance sensor 565. The distance sensor 565 may be a proximity switch, the control module may be a PLC in the carton sealer, the control module receives a signal from the distance sensor 565 to control the cutting motor 561 to pause, and the starting of the cutting motor 561 can be controlled by outputting a signal to the control module by an operation panel or a button of the carton sealer. The position of the eccentric pin 563 is sensed by the distance sensor 565, when the eccentric pin 563 rotates upwards to be located above the eccentric wheel 562, the distance sensor 565 is triggered to send the signal to the control module, and the control module controls the cutting motor 561 to drive the eccentric wheel 562 to rotate until the swing rod 564 drives the movable blade 53 to be away from the fixed blade 52, thereby completing the reset of the cutting device and waiting for the next cutoff instruction.

In conclusion, according to the present disclosure, the cutting edge of the movable blade 53 is designed to be of the isosceles triangle structure. When the movable blade 53 slides to the fixed blade 52 to cut off the tape 21, a process that the two second edge parts 531 in the isosceles triangle structure perform cutoff from two sides to the middle of the tape 21 can be formed. In this way, a resistance caused when the tape 21 is cut by using the movable blade 53 can be reduced, it is convenient to cut off the tape 21 with higher toughness, and a torque required to drive the movable blade 53 to slide can be reduced, so that the way is also beneficial to the conservation of electric energy required by the cutting motor 561. In addition, by sensing the position of the eccentric pin 563 through the distance sensor 565 in a process that the tape 21 is cut off, the position of the movable blade 53 relative to the fixed blade 52 can be further controlled, and the movable blade 53 can automatically reset to be away from the fixed blade 52 after sliding to the fixed blade 52 to cut off the tape 21, so that the tape 21 can smoothly pass through a space between the movable blade 53 and the fixed blade 52 and pass through the tape through hole 511, which is convenient for re-packaging and cutoff.

The above descriptions are only specific implementations of the present disclosure, however, the design concept of the present disclosure is not limited thereto. Any non-substantive changes on the present disclosure based on this concept should fall within behaviors that violate the protection scope of the present disclosure.

What is claimed is:

1. A tape cutting device, wherein the device comprises:

a cutter holder, the cutter holder being provided with a penetrative tape through hole, and the penetrative tape through hole being configured to accommodate a tape passing through the tape through hole;

a fixed blade, the fixed blade being fixed in the cutter holder and being located on one side of the tape through hole; and a movable blade, the movable blade being located on the other side of the tape through hole and sliding relative to the fixed blade;

wherein a side, corresponding to the fixed blade, of the movable blade is sunken to form a cutting edge, the cutting edge forms a V shape structure, each of two equal sides in the V shape structure forms a second edge part;

wherein two sides of the movable blade both extend to the fixed blade to form extension parts; and elastic sheets are fixed on two sides of the cutter holder, the elastic sheets are bent to the fixed blade to form elastic parts, and the two extension parts are respectively pressed to the fixed blade by the two elastic parts.

2. The tape cutting device according to claim 1, wherein the movable blade is fixed on a sliding seat, limiting columns are fixed on two sides of the sliding seat, penetrative limiting holes are formed in two sides of the cutter holder, and the two limiting columns adaptively penetrate into the two limiting holes, respectively.

3. The tape cutting device according to claim 1, wherein the device further comprises a cutting motor, an eccentric wheel and a swing rod, the cutting motor is fixed on a mounting frame, the eccentric wheel is fixed on an output shaft of the cutting motor, and an eccentric pin is fixed on a position, deviated from the center of a circle, on the surface of the eccentric wheel; and a position close to the middle of the swing rod is limited to rotate relative to the cutter holder, one end of the swing rod is limited to rotate relative to the movable blade, the other end of the swing rod is provided with a waist-shaped hole, and the waist-shaped hole sleeves the outside of the eccentric wheel, so that the eccentric pin pushes the waist-shaped hole of the swing rod to swing.

4. The tape cutting device according to claim 3, wherein the device further comprises a distance sensor and a control module, the distance sensor is fixed outside a side of the eccentric wheel and is triggered after sensing that the eccentric pin gets close, and the control module receives a signal for triggering the distance sensor and controls the cutting motor to pause; and when rotating to be close to the distance sensor, the eccentric pin pushes the swing rod so as to drive the movable blade to be away from the fixed blade.

5. The tape cutting device according to claim 1, wherein pressing plates are fixed on two sides of the tape through hole in the cutter holder, avoidance gaps are formed in surfaces, facing an inner surface of the cutter holder, of the pressing plates, and two sides of the fixed blade are respectively nested in the two avoidance gaps, so that the fixed blade is pressed to the cutter holder by the pressing plates so as to be fixed.

* * * * *